US005755377A

United States Patent [19]

Durand

[11] Patent Number: 5,755,377

[45] Date of Patent: May 26, 1998

[54] CARTON HAVING ADDITIONAL RECTILINEAR CORNERS

[75] Inventor: Jean-Jacques Durand, Arques, France

[73] Assignee: Verrerie Cristallerie d'Arques, J. G. Durand et Cie, France

[21] Appl. No.: 738,720

[22] Filed: Oct. 28, 1996

[51] Int. Cl.[6] ..... B65D 5/64

[52] U.S. Cl. ..... 229/110; 229/157; 229/158

[58] Field of Search ..... 229/108, 110, 229/156, 157, 158

[56] References Cited

U.S. PATENT DOCUMENTS

| | | | |
|---|---|---|---|
| 482,480 | 9/1892 | Howe | 229/157 |
| 529,308 | 11/1894 | Pinkerton | 229/157 |
| 697,668 | 4/1902 | Schleicher | 229/158 |
| 923,111 | 5/1909 | Boberg | 229/157 |
| 1,127,734 | 2/1915 | Compton | 229/157 |
| 2,114,052 | 4/1938 | Kincade, Jr. | 229/110 |
| 2,123,147 | 7/1938 | Snyder | 229/110 |
| 2,167,917 | 8/1939 | Vogt | 229/156 |
| 2,337,198 | 12/1943 | Holy | 229/157 |
| 3,302,853 | 2/1967 | Locke | 229/157 |
| 4,850,527 | 7/1989 | Church et al. | 229/110 |

FOREIGN PATENT DOCUMENTS

| | | | |
|---|---|---|---|
| 827345 | 5/1981 | U.S.S.R. | 229/110 |

*Primary Examiner*—Gary E. Elkins
*Attorney, Agent, or Firm*—Leonard J. Santisi

[57] ABSTRACT

A box-shaped carton having additional rectilinear corners for holding a plurality of glassware articles, which has increase vertical and/or horizontal stiffness for storing and stacking purposes. The carton includes at least five side panels to form at least one additional flat edge from the increased rectilinear corners for displaying printed material about the stored articles. The carton also can be folded into a sleeve when fully glued together. A blank for forming the carton is also provided.

4 Claims, 4 Drawing Sheets

CARTON HAVING ADDITIONAL RECTILINEAR CORNERS

FIELD OF INVENTION

The present invention relates a novel packaging means for storing and displaying articles, and more particularly, to an improved carton having additional rectilinear corners that increase the weight supporting capability and form flat edges for displaying printed advertisements of the carton.

BACKGROUND OF THE INVENTION

Paperboard cartons or display packages capable of holding a plurality of articles such as cans, bottles, stemware, and the like are known in the art. Such paperboard cartons are typically made from one or more blanks of paperboard, folded and glued together into a rectangular box with the aid of various machines.

As is to be appreciated, many of these paperboard containers are constructed into a rectangular shape with four angles or corners, two surfaces, and four side panels. Certain known display packages contain cut-a-way viewing windows that enable a consumer to inspect the packaged article without tampering with the packaging or without having to open the package.

The conventional structure of a standard cardboard box used to store articles form four rectilinear corners that provide adequate vertical stiffness to prevent premature collapsing of the paperboard carton, when the articles are packaged. However, the standard cardboard box, with its four corners, has certain limitations on the weight-supporting capability of the box. These limitations hamper the stacking capability of the cartons. As a result, only certain loads can be stacked on top of these conventional cardboard boxes for displaying the stored articles.

With respect to the prior art cartons that are sealed without cut-out viewing windows, the customer must rely on the illustrations shown on the outside of the carton to decide whether or not to purchase the item. That is, the manufacturer depicts the characteristics, function, and features of the articles stored within the carton primarily by the artwork on the exterior panels of the cartons. For example, with glassware, it is often desirable to show a photograph of the glassware if a cut-out window display is not available, together with the brand name of the product and the name of the manufacturer.

In today's age, advertising and marketing schemes play an important role in the consumer selection and perception of consumer items, in particular, housewares products. Therefore, the attractiveness of the packaging together with a recognizable brand name become a key part in the consumer buying world. As a result by increasing the available printed exterior surfaces on a carton, the more space the illustrator has to depict and describe the features of the article packaged within the carton. In addition, the manufacturer has the option to single out the brand name of the stored article on one of the additional printed surfaces.

Thus, the prior art has failed to provide a carton capable of being easily assembled and dissembled for transporting purposes, which has additional printed surfaces for use in offsetting the brand name of the product or name of the manufacture, from the remaining packaging information on the exterior panels of the carton. The carton construction of the present invention is novel over the prior art because it allows the manufacturer the option of isolating the brand name of the stored articles from the artwork or other information provided on the packaging without an increase in cost or manufacturing time. This novel carton construction enables a consumer to easily and quickly recognize the desired brand name of the article on the shelf without spending unnecessary time in inspecting the remaining cartons on the shelf.

In addition, the prior art has failed to provide an improved carton having additional rectilinear corners, which is conveniently constructed for holding articles, while having an increase in the weight supporting capabilities due to the increase in vertical stiffness of the carton. Conventional cartons have only four rectilinear corners that provide only a certain amount of stiffness, but are subject to premature collapsing because of the limited weight-supporting capabilities. Rather, as will be discussed in the present invention, the prior art has failed to provide a relatively low-cost means for increasing the weight supporting capability of articles stored within the carton and for increasing the load potential of the number of stacked cartons.

OBJECTS AND SUMMARY OF THE INVENTION

An object of the present invention is to provide a simplified point of sale display carton having additional rectilinear corners that increase the vertical and/or horizontal stiffness of the carton to prevent premature collapsing, which overcomes the problems associated with the prior art.

Specifically, it is an object of the present invention to provide carton for storing articles including glassware that has additional exterior flat surfaces formed from the added rectilinear corners for printing advertisements.

More specifically, it is object of the present invention to provide a carton that provides a unique stacking arrangement which is relatively inexpensive.

It is still an object of the present invention to provide a relatively low-cost improved and simplified carton which can be collapsed into a sleeve for transportation after the blank has been formed.

Another object of the present invention is to provide a relatively low-cost carton which has an increase weight-supporting capability to withstand heavy loads for carton stacking purposes on store shelves.

An aspect of this invention is to provide a carton which has at least five side panels, a top panel, a bottom panel, that forms at least five rectilinear corners when assembled from a blank. The carton constructed in accordance with the present invention has increased vertical and horizontal stiffnesses, which are ideal for packaging, shipping and stacking. The unique flat edge surfaces of the present invention formed from the additional corners provide for an unique display on a store shelf. The carton for storing and advertising articles comprising: a carton for storing and advertising a plurality of glassware articles or the like comprising: a top, a bottom, and at least five side panels connected to each other along vertical fold lines to form at least five rectilinear perimeter corners of the carton, and each of the side panels having an upper flap and a lower flap. In addition, the carton top includes a first and second outer top flaps, each of said outer flaps being connected to a respective side panel along a horizontal fold line at the upper edge of its respective side panel, the first outer top flap having a pair of female members, and the second outer top flap having a first pair of male slots for receiving the female members of the first outer top flap; and a first and second inner top flaps being connected to a respective side panel along a horizontal fold line at the upper edge of its respective side panels, the inner flaps having second male slots for receiving the female members of the first outer top flap after being inserted into the first male slots of the second outer top flap. In an alternate embodiment, the second male slots of the first and second inner top flaps are wider than the first male slots to facilitate receipt of the female members of the outer top flaps. Furthermore, the bottom of the carton includes a first pair of outer bottom flaps and second pair of inner bottom flaps connected to respective side panels along horizontal fold lines at the corner edges of the side panels, the first pair of outer bottom flaps being overlapping fixed together with the second pair of inner bottom flaps by fastening means.

The present invention provides a blank for producing a multicelled carton for storing and advertising a plurality of glassware articles, comprising: at least a first, second, third, fourth and fifth side panel sections for forming a left side, first edge, a right side, a front side and a back side arranged in a row and connected to each other along substantially parallel fold lines, and first, second, third, fourth, and fifth side panel sections connected by fold lines to respective ones of first, second, third, fourth, and fifth side panel sections. Preferably, the blank includes the first and third side panel sections, which define a first pair of opposing top outer flaps, one of the top outer flap includes a male slot and the other top outer flap includes female members, the first pair of top outer flaps connected along a horizontal fold line to the first and third panel sections, the second, fourth and fifth side panel sections define a second pair of opposing top inner flaps, each of the second pair of top inner flaps include a male slot, the second pair of top outer flaps connected along a horizontal fold line to the second, fourth and fifth side panel sections.

Other objects, features and advantages according to the present invention will become apparent from the following detailed description of the illustrated embodiments when read in conjunction with the accompanying drawings in which corresponding components are identified by the same reference numerals.

DETAILED DESCRIPTION OF THE DRAWINGS

Figure 1:
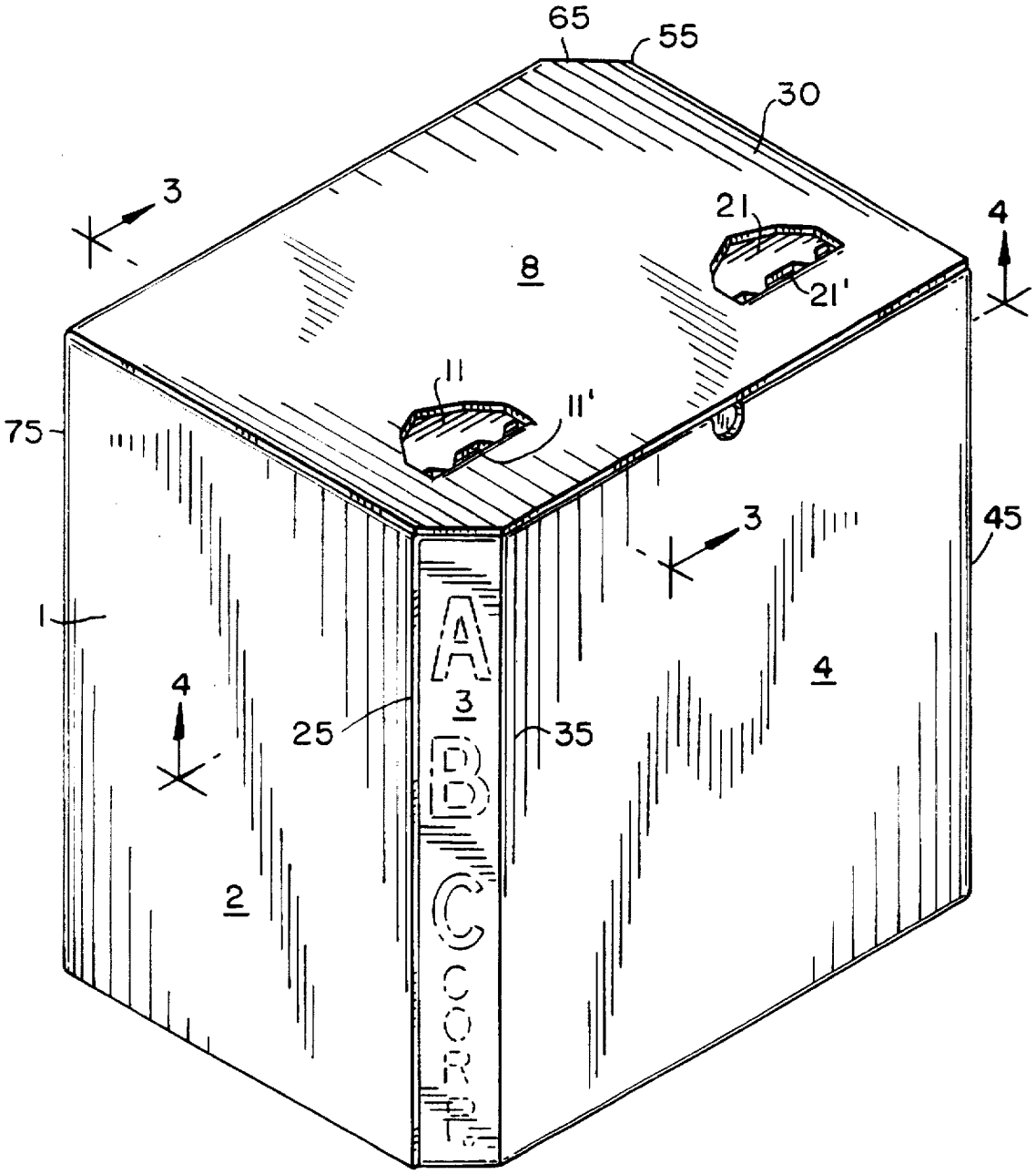
FIG. 1 is a perspective view of the carton, fully assembled with the top closed, and containing the glassware articles.
Figure 2:
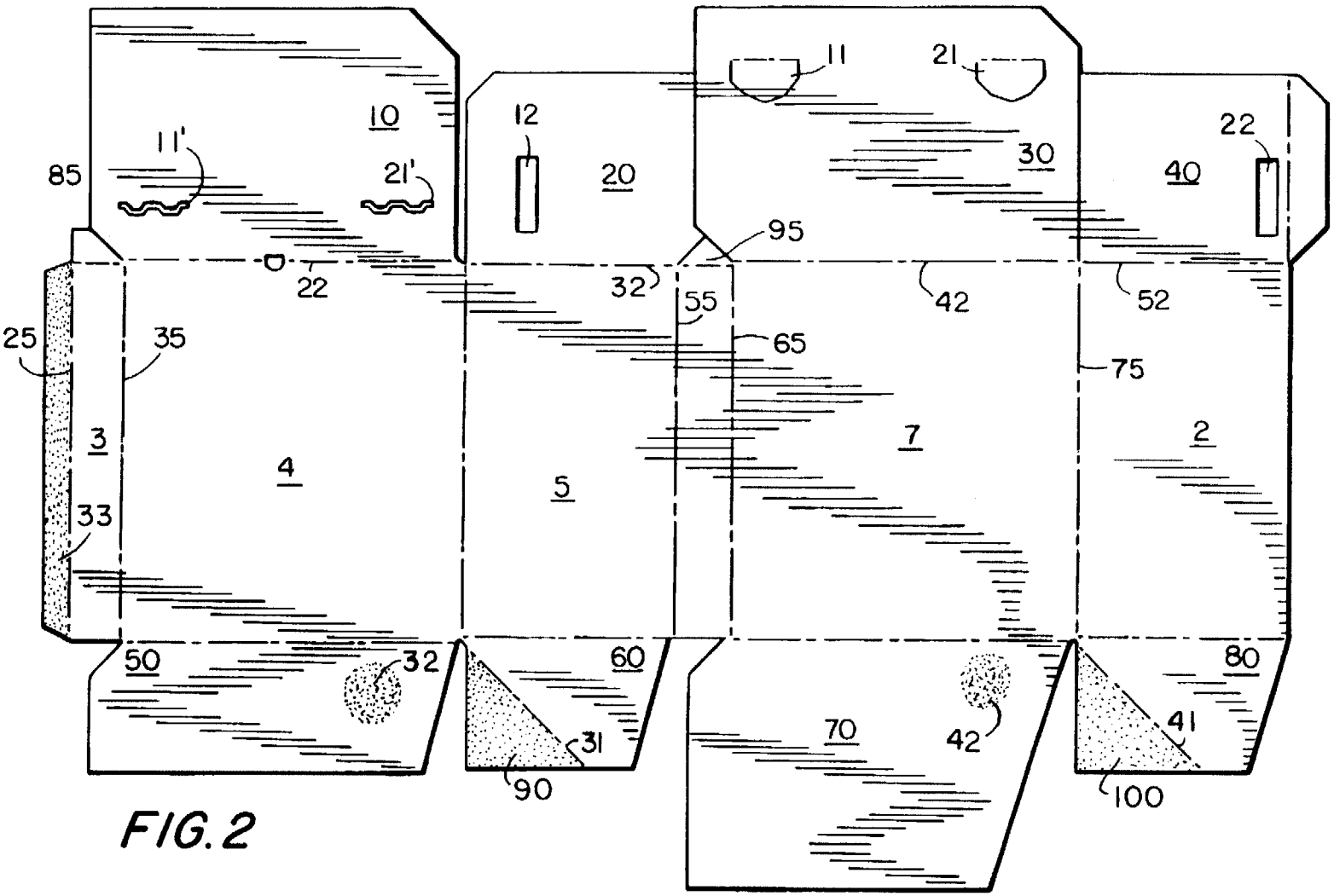
FIG. 2 is a plan view of a production blank used to form the carton of the present invention.

FIG. 1 illustrates a fully assembled carton 1 for displaying articles, namely glassware or stemware, in accordance with an embodiment of the present invention. As shown therein, the carton is preferably box-shaped, but can be octagon-shaped, hexagon-shaped, and oval-shaped. The carton is preferably made of cardboard or other types of rigid material. The preferred embodiment, the box-shaped carton, is preferably formed from a single pre-cut and pre-scored blank as depicted in FIG. 2. The preferred pre-cut blank is formed having at least six side panels 2, 3, 4, 5, 6, and 7, which are fully visible in FIG. 2. An alternative embodiment of the present invention is a preferred box-shaped carton having at least five side panels (not shown). The carton can also preferably be formed using inner partitions (not shown) to separate each of the stored articles of glassware.

The side panels 2, 3, 4, 5, 6, and 7 are connected to each other by rectilinear folded corners 25, 35, 45, 55, 65, and 75. That is, corner 25 is located between side panels 2, 3 as shown in FIG. 1. In FIG. 2, corner 35 is located between side panels 3, 4; corner 45 is located between side panels 4, 5; corner 55 is between side panels 5, 6; corner 65 is located between side panels 6, 7; and corner 75 is located between side panels 7, 2. Side panel 3 has a edge 33 that extends vertically down the length of side panel 3 as depicted in FIG. 2.

The rectilinear corners of a carton give the carton weight-supporting capability. By having an increase in the number of rectilinear corners, to the minimum of five and to the maximum of eight rectilinear corners, the carton 1 of the present invention is provided with a significant increase in vertical and horizontal stiffnesses. This, in turns, significantly increases the weight-supporting capability of the carton 1 made in accordance with the present invention.

Figure 3:
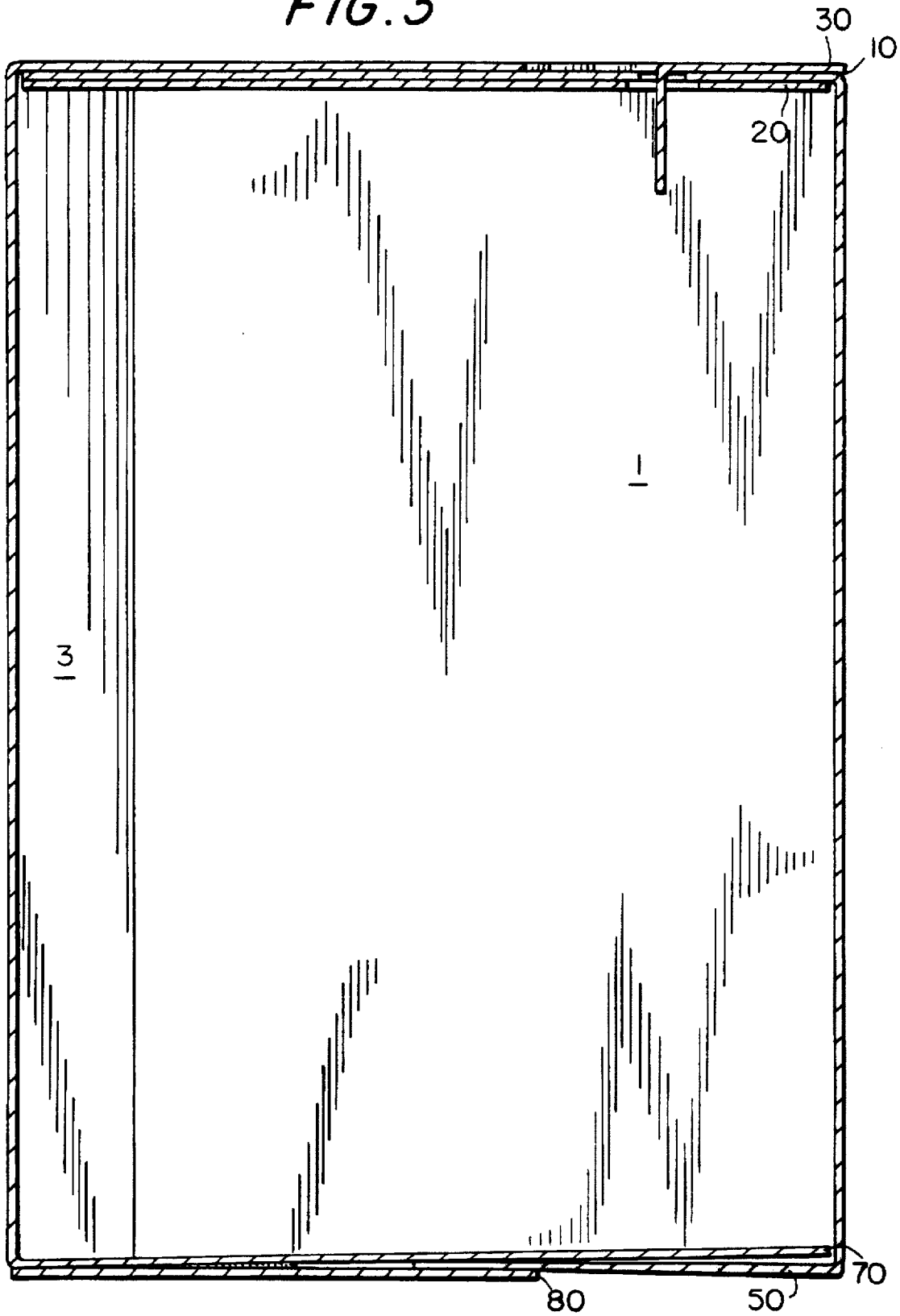
FIG. 3 is a sectional view of the carton in FIG. 1 taken along the line 3—3.
Figure 4:
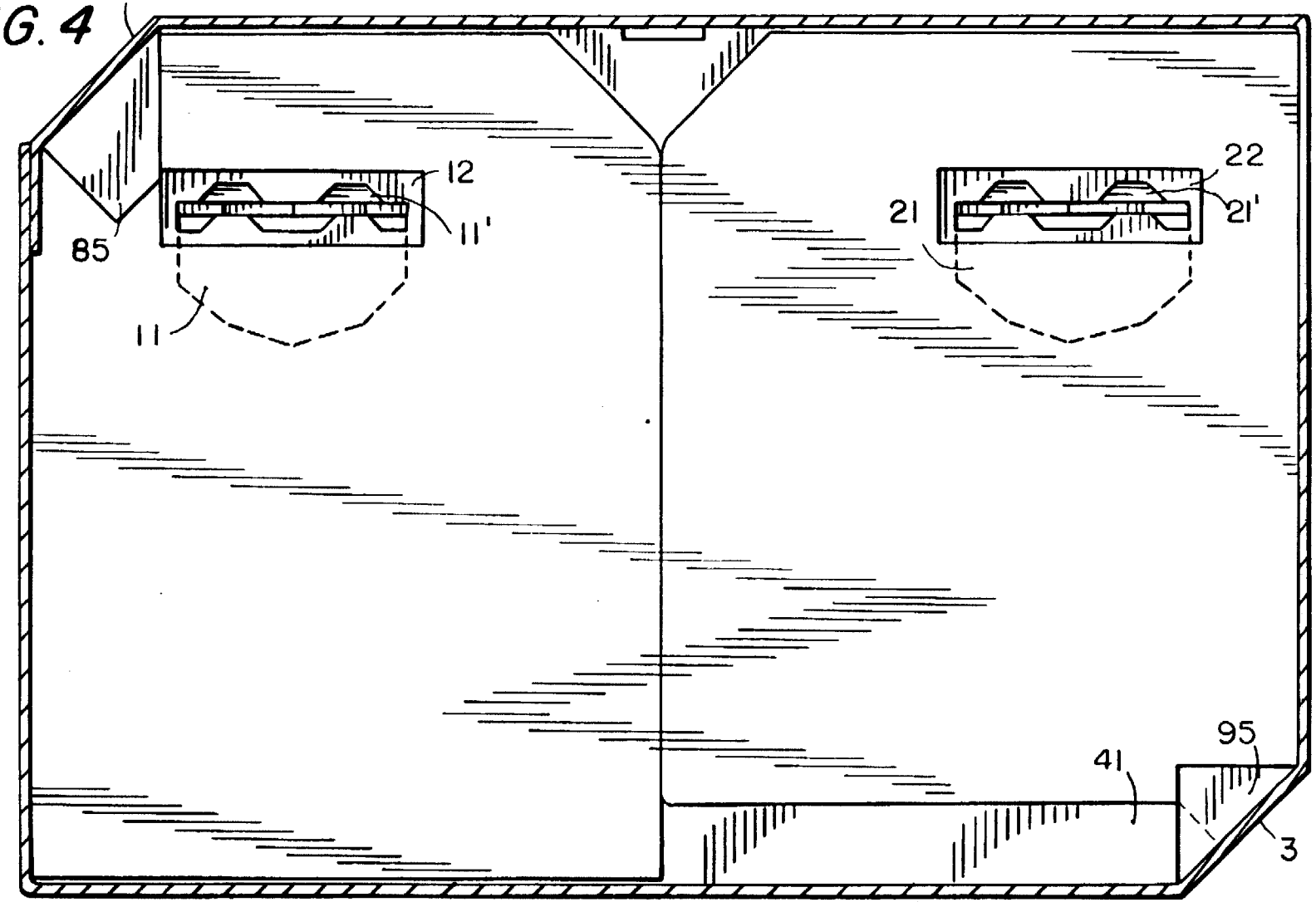
FIG. 4 is a sectional view of the carton in FIG. 1 taken along the line 4—4.

The carton 1 also includes a top 8 shown in FIG. 1. The top 8 of the carton 1 is comprised of two outer flaps 10, 30 and two internal top flaps 20, 40 as shown in FIGS. 2–3. A closed carton top 8 of the carton 1 is depicted in the sectional view of FIGS. 3–4, comprising at least three layers 30, 10, 20 or 30, 10, 40 at the carton folds. The first outer layer is outer flap 30, which contains at least two movable tongues or female members 11, 21 located at the extreme ends of the outer flap 30. The tongues 11, 21 are adapted to be inserted into the two male slots 11', 21' of the second outer flap 10 to form a second layer and then into the inner slots 12, 22 located on each of the inner flaps 20, 40 to form a third layer as shown in FIGS. 1, 3–4. The fully assembled locking arrangement of the top 8 of the carton 1 is illustrated in FIG. 4.

Preferably, the slots 12, 22 are rectangular shaped and located at the extreme end of the inner flaps 20 and 40, respectively, as in FIGS. 2–3. The slots are preferably wider in width dimension than the width dimensions of tongues or female members 11, 21 to facilitate receipt of the tongues 11, 21 of outer flap 30 shown in FIG. 4.

With reference to FIGS. 2–3, the construction of the bottom 9 of the carton 1, will now be described. The bottom 9 is comprised of two bottom outer flaps 60, 80, and two internal bottom flaps 50, 70. As shown in FIG. 2, which depicts the outer face of the production blank for the carton 1 prior to folding or assembly, each of the bottom flaps 50, 60, 70 and 80 respectively are preferably of a generally trapezoidal shape, but can alternatively be rectangular shaped with the bottoms flaps being various sizes and dimensions.

In addition, the bottom outer flaps 60, 80 respectively include generally triangular glue edges 90, 100 (the glue being placed on the back side), as indicated in FIG. 2 by the dotted lines. The bottom outer flaps 60, 80 are connected to the preferably glue edges along a diagonal fold lines 31, 41, respectively. Prior to assembling the bottom 9 of the carton 1, fastening means are applied to internal flaps 50 and 70 by glue spots 32, 42 (the glue being place on the front side, as indicated in the FIG. 2 by stippling) for receiving and securing the bottom outer flaps 60 and 80 to the bottom inner flaps 50, 70.

In FIG. 2, when the blank is to be assembled into a carton 1, side panel sections 2, 7 are folded inwardly along fold line 75 to form a first vertical rectilinear corner. Simultaneously, bottom internal flap 70 is folded inwardly to form a first horizontal rectilinear corner. Next, glue or other adhesive means, is applied to the inside face of triangular glue edge 100 of bottom outer flap 80. Then, the first bottom outer flap 80 is folded inwardly to form a second horizontal rectilinear corner and glue edge 100 is pressed flat against the outside of first bottom internal flap 70, which has glue or other adhesive means 42 applied to the outside face of internal flap 70, to hold and secure the side panels 2, 7 in the perpendicular relationship.

Most of the same steps are repeated for folding the remaining side panel sections. For instance, side panel sections 7, 6 are folded inwardly along fold line 65 to form a second vertical rectilinear corner. Subsequently, side panel sections 6, 5 are folded inwardly along fold line 55 to form a third vertical rectilinear corner. Again, simultaneously, bottom outer flap 60 with second glue edge 90 is folded inwardly to form a third horizontal rectilinear corner.

Prior to pressing the second glue edge 90 to the second bottom internal flap 50, side panel sections 5, 4 are folded inwardly along fold line 45 to form a fourth vertical rectilinear corner. When panel section 4 is folded, the panel sections 4 and 3 cover the entire width of the side panel section 7, 6 to abut or contact side panel section 2. Simultaneously, second bottom internal flap 50 is also folded inwardly with glue or other adhesive means 32 applied to the outer face of bottom internal flap 50. Then, bottom flap 50 is pressed flat against the outside surface of bottom internal flap 70 to form a fourth horizontal rectilinear corner. Glue means or other adhesive means previously applied to the inside face of triangular glue edge 90 of the second bottom outer flap 60, is firmly pressed against the glue means 32 of the bottom flap 50 to secure and hold the bottom inner and outer flaps 50, 60, 70, 80 firmly together.

Then, side panels sections 4, 3 are folded inwardly along fold line 35 to form a fifth rectilinear corner. Next, side panel 3 and edge 33 are folded inwardly along fold line 25 to form the sixth vertical rectilinear corner. Next, glue is applied to the outside face of the entire length of edge 33 that extends vertical along the side panel 3. The glued edge 33 of side panel 3 is then pressed flat against the inside of side panel section 2, and is glued to it, which holds all the side panels sections, 2, 7, 6, 5, 4, and 3 firmly together in a perpendicular relationship to form a carton having four side panels, at least one flat edge, a top and bottom.

As depicted in FIGS. 2–4, to close the fully assembled carton of the present invention, the construction and operation of top 8 will be described. As discussed earlier, top 8 is preferably comprised of top flaps 10, 20, 30, and 40. Each of the top flaps 10, 20, 30, and 40 is respectively connected to side panels by respective fold lines. That is, top flap 10 is connected to side panels 3 and 4 by fold line 22, top flap 20 is connected to side panels 5 and 6 by fold line 32, top flap 30 is connected to side panel 7 by fold line 42, and top flap 40 is connected to side panel 2 by fold line 52 as shown FIG. 2. Top flap 40 has as edge 41 which is connected to flap 40 by 62.

Each of the top flaps 10, 20, 30, and 40 include respective generally rectangular portions having tapered edges as depicted in FIG. 2. The trapezoidal edges 85, 95 of side panels sections 3, 6, respectively, are first folded inwardly as shown in FIG. 4. The edge 41 of top inner flap 40 is folded inwardly along fold line 62 as shown in FIG. 4.

Then, the internal flaps 20, 40 are folded inwardly towards the center of the carton 1. The top outer layer 30 is folded inwardly on top of the internal edges 20, 40 so that the second slots 12, 22 set the alignment with the first slots 11', 22' of the second outer top flap 10, to form, in essence, two combined slots for receiving the two tongues or female members 11, 21 located on top outer flap 30.

At that time, the first top outer flap 30 is folded inwardly on top of the second top outer flap 10 with the tongue or female members 11, 21 vertically extended. The tongues 11, 21 are inserted into the first male slots 11', 21' of the second top outer flap 10 and then into the second male slots 12, 22 of the outer inner flaps 20, 40, respectively. This interlocking arrangement firmly holds the top flaps 10, 20, 30, and 40 together without the need for glue, but securing all the articles placed within the carton 1. Thus, the top flaps 10, 20, 30, and 40 of the carton 1 can be conveniently opened and closed repeatedly, as desired.

As can be seen in FIGS. 1 and 4, when the top flaps 10, 20, 30, 40 of the carton 1 are fully closed, and the side sections 3, 4, 5, 6, 7, 2, are fully, assembled, additional rectilinear flat edges 3, 6 are formed.

In an alternative embodiment, divider flaps can be formed with the production of the blank to create four separate cell-dividers as fully described in U.S. patent application Ser. No. 08/540,888 filed Oct. 11, 1995, which has been allowed and shares a common assignee with the present application, and which is hereby incorporated by reference; however, such subject matter is not believed necessary to the understanding of the present invention.

Furthermore, in another alternative embodiment, cutout openings, which allow the customer to view the contents of the stored articles within the carton without the need to open the carton, can be formed during the production of the blank made in accordance with the present invention. The creation of cutout openings is more fully described in the above-referenced patent application, U.S. Ser. No. 08/540,888, which is incorporated herein by reference.

Owing to the novel construction of the increase rectilinear corners, the assembled carton 1 can be readily collapsed into a flat sleeve for storage and transportation even after the carton is completely glued together.

Furthermore, although preferred embodiments of the present invention and modifications thereof have been described in detail herein, it is to be understood that this invention is not limited to those precise embodiments and modifications, and that other modifications and variations may be affected by one skilled in the art without departing from the spirit and scope of the invention as defined by the appended claims.

What is claimed is:

1. A carton for storing and advertising a plurality of glassware articles comprising: a top, a bottom, and at least five side panels connected to each other along vertical fold lines to form at least five rectilinear perimeter corners of the carton, and at least four of the side panels having an upper flap and a lower flap; wherein said top includes the upper flaps of the side panels connected to a respective side panel along a horizontal fold line at an upper edge of the respective side panel, wherein at least one of the upper flaps has a pair of female members, and the other upper flaps have pairs of male slots for receiving the female members of the one flap after being assembled.

2. The carton defined in claim 1, wherein the male slots of the at least two of the other upper flaps are wider than the male slots of the upper flap to facilitate receipt of the female members of the flap.

3. The carton defined in claim 1, wherein the bottom of the carton includes a first pair of outer lower flaps and a second pair of inner lower flaps connected to the respective side panels along horizontal fold lines at a corner edge of at least four of the side panels, the first pair of outer bottom flaps being overlapping fixed together with the second pair of inner bottom flaps by fastening means.

4. A blank for producing a multicelled carton for storing and advertising a plurality of glass-ware articles, comprising:

at least a first, second, third, fourth and fifth side panel sections for forming a left side, first edge, a right side, a front side and a back side arranged in a row and connected to each other along substantially parallel fold lines, the first, second, third, fourth, and fifth side panel sections connected by the fold lines to respective ones of first, second, third, fourth, and fifth side panel sections, and wherein the first and third side panel sections are attached to a first pair of opposing top outer flaps, one of the outer flaps includes female members and the other outer flap includes a pair of male slots for receiving the female members when the carton is formed, the first pair of outer flaps connected along a first horizontal fold line to the first and third panel sections, the second, fourth, and fifth side panel sections are attached to a second pair of opposing top inner flaps, each of the second pair of inner flaps include a male slot for receiving one of the female members when the carton is formed, the second pair of opposing top inner flaps connected along a second horizontal fold line to the second, fourth, and fifth side panel sections.

* * * * *